US007217053B2

(12) United States Patent
Alexander et al.

(10) Patent No.: US 7,217,053 B2
(45) Date of Patent: May 15, 2007

(54) WATER FLOOR BROOM WITH CLEAN-UP SQUEEGEE

(75) Inventors: Gus Alexander, Inverness, IL (US); Karen Chen, Shanghai (CN)

(73) Assignee: FAIP North America, Inc., Elk Grove Village, IL (US)

( * ) Notice: Subject to any disclaimer, the term of this patent is extended or adjusted under 35 U.S.C. 154(b) by 0 days.

(21) Appl. No.: 11/095,805

(22) Filed: Mar. 31, 2005

(65) Prior Publication Data

US 2006/0222438 A1 Oct. 5, 2006

(51) Int. Cl.

| | |
|---|---|
| ***A47L 13/26*** | (2006.01) |
| ***A47L 13/30*** | (2006.01) |
| ***A47L 7/00*** | (2006.01) |
| ***A46B 11/00*** | (2006.01) |
| ***B05B 9/00*** | (2006.01) |

(52) U.S. Cl. ..... 401/139; 401/48; 401/261; 401/263; 15/321; 239/147; 239/159; 239/172

(58) Field of Classification Search ..... 401/48, 401/261, 265, 266, 139, 263; 15/320, 321, 15/322; 134/104.2; 239/146, 147, 159, 239/172

See application file for complete search history.

(56) References Cited

U.S. PATENT DOCUMENTS

| | | | | |
|---|---|---|---|---|
| 2,638,730 | A * | 5/1953 | Davidson | 56/400.14 |
| 5,865,549 | A * | 2/1999 | Kinard et al. | 401/48 |
| 6,598,262 | B2 * | 7/2003 | Farina | 15/321 |
| 6,776,363 | B1 * | 8/2004 | Falletta et al. | 239/722 |
| 6,935,579 | B1 * | 8/2005 | Lindsey | 239/530 |

* cited by examiner

*Primary Examiner*—David J. Walczak
(74) *Attorney, Agent, or Firm*—Leydig, Voit & Mayer, Ltd.

(57) ABSTRACT

A water floor broom having a spray head that defines an elongated manifold liquid flow passageway communicating with a plurality of liquid spray nozzles, a handle fixed to said body defining a liquid flow passageway communicating with said spray head, and a power washer coupled to said handle for directing pressurized liquid via said handle to said spray head for discharge from the spray nozzles for cleaning a floor surface. The spray head has a light weight, rigid plastic construction that can be operated with lesser quantities of cleaning liquids, and a squeegee blade secured rewardly of the spray head for simultaneously scraping and cleaning water from the floor surface directed onto the floor surface by the spray head for minimizing or eliminating subsequent cleanup.

17 Claims, 2 Drawing Sheets

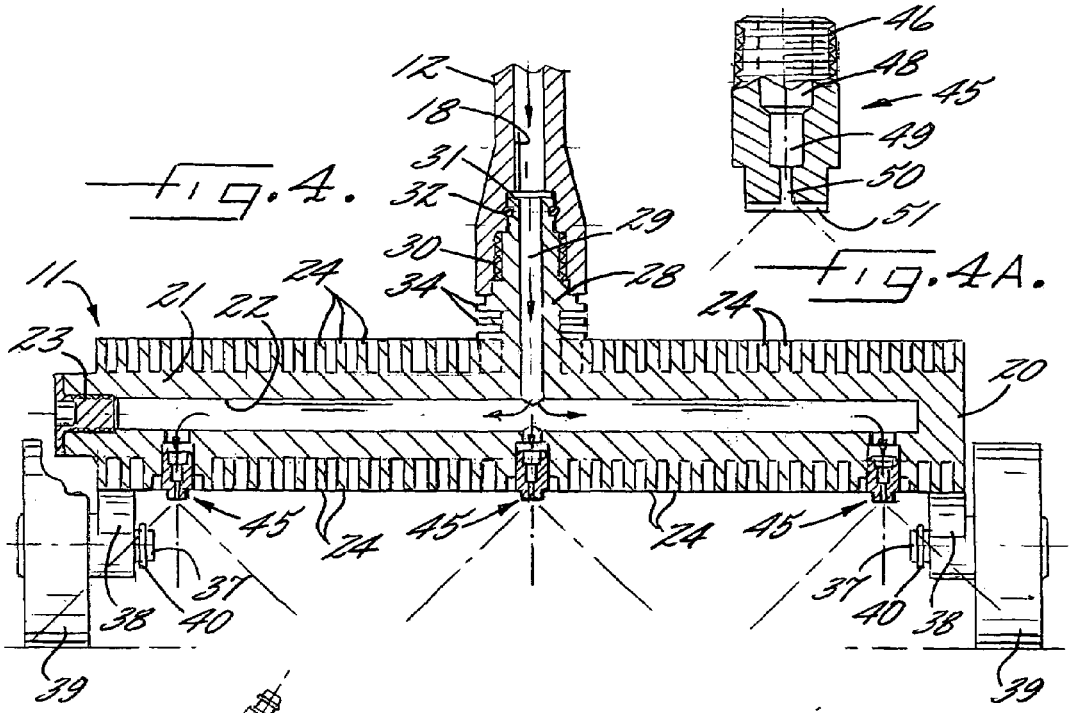
Fig. 4.
Fig. 4A.
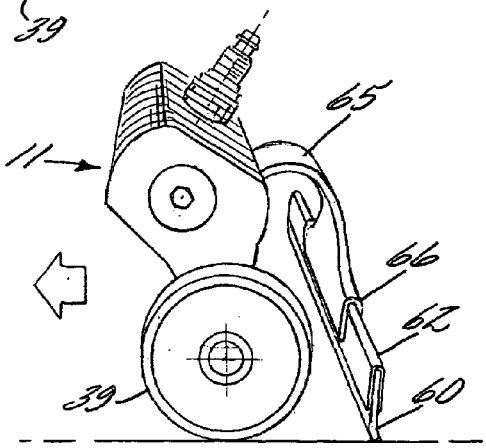
Fig. 5A.
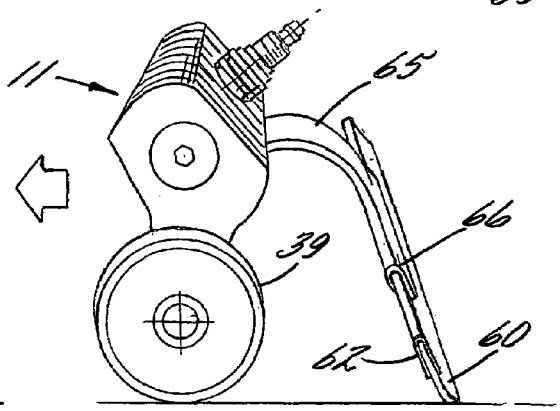
Fig. 5B.
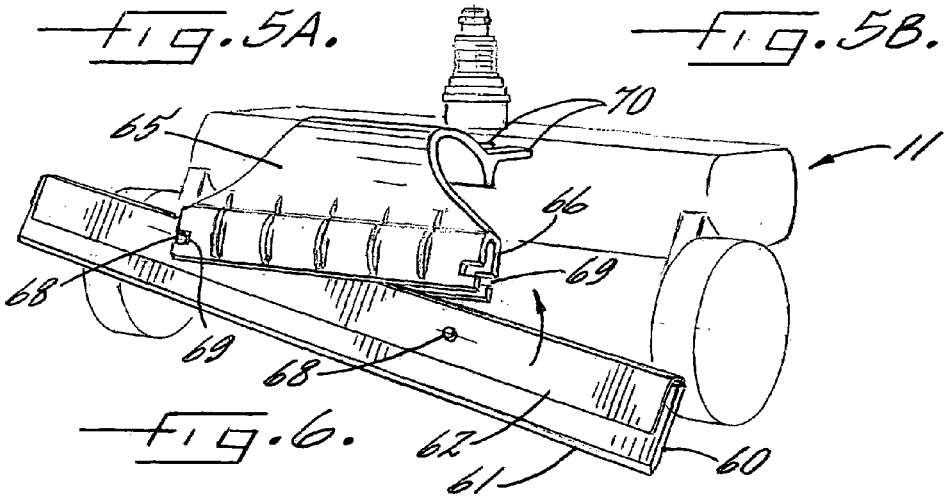
Fig. 6.

WATER FLOOR BROOM WITH CLEAN-UP SQUEEGEE

FIELD OF THE INVENTION

The present invention relates generally to floor cleaning devices, and more particularly, to water spray floor cleaning devices sometimes referred to in the industry as water floor brooms.

BACKGROUND OF THE INVENTION

Water floor brooms are known of the type which have a cleaning head that is movable along the floor and which has a plurality of downwardly directed liquid spray nozzles communicating with a manifold liquid flow passageway in the cleaning head, which in turn communicates with a liquid flow passageway in a handle of the broom. The handle is releaseably coupled to the wand of a conventional power washer pump that is operable for directing a pressurized liquid through the handle and cleaning head for discharge from the nozzles onto the floor in pressurized liquid flow streams as the cleaning head is manually moved along the floor by an operator by means of the handle. Conventional water floor brooms suffer from a number of drawbacks which detract from their wide-spread or efficient usage. At the outset, since water floor brooms often are designed for commercial usage, they can be heavy and massive, making it difficult to manually use or manipulate over long periods of time. Moreover, to provide adequate liquid flow and pressurization for thorough cleaning, such water floor brooms typically are used with gas powered pressure washer pumps, which also are relatively heavy, cumbersome to handle, and expensive to manufacture. A further drawback of existing water floor brooms is that while they can be effective in cleaning floors, considerable water is directed onto the floor which must later be mopped up or otherwise disposed of to complete the cleaning task.

OBJECTS AND SUMMARY OF THE INVENTION

It is an object of the present invention to provide a water floor broom that is adapted for easier and more efficient usage in cleaning of floors.

Another object is to provide a water floor broom as characterized above which is adapted to substantially minimize or eliminate the necessity for later mopping of water directed onto the floor during cleaning.

A further object is to provide a water floor broom of the above kind that is relatively light in weight and economical in construction.

Still another object is to provide a water floor broom of the foregoing type that is operable for effectively cleaning floors with lesser quantities of water or other cleaning liquids. A related object is to provide a water floor broom of such type which is operable by a relatively lighter weight and more economical electric powered pressure washer pump.

Other objects and advantages of the invention will become apparent upon reading the following detailed description and upon reference to the drawings, in which:

BRIEF DESCRIPTION OF THE DRAWINGS

FIG. 4 is an enlarged vertical section of the spray head taken in the plane of line 4—4 in FIG. 3;

FIG. 4A is an enlarged partial section of one of the spray nozzles of the illustrated spray head;

FIGS. 5A and 5B are side elevational depictions showing the rear water squeegee of the illustrated water floor broom in different operative positions relative to a floor surface; and FIG. 6 is a perspective of the squeegee blade and mounting support in partially assembled position.

Figure 1:
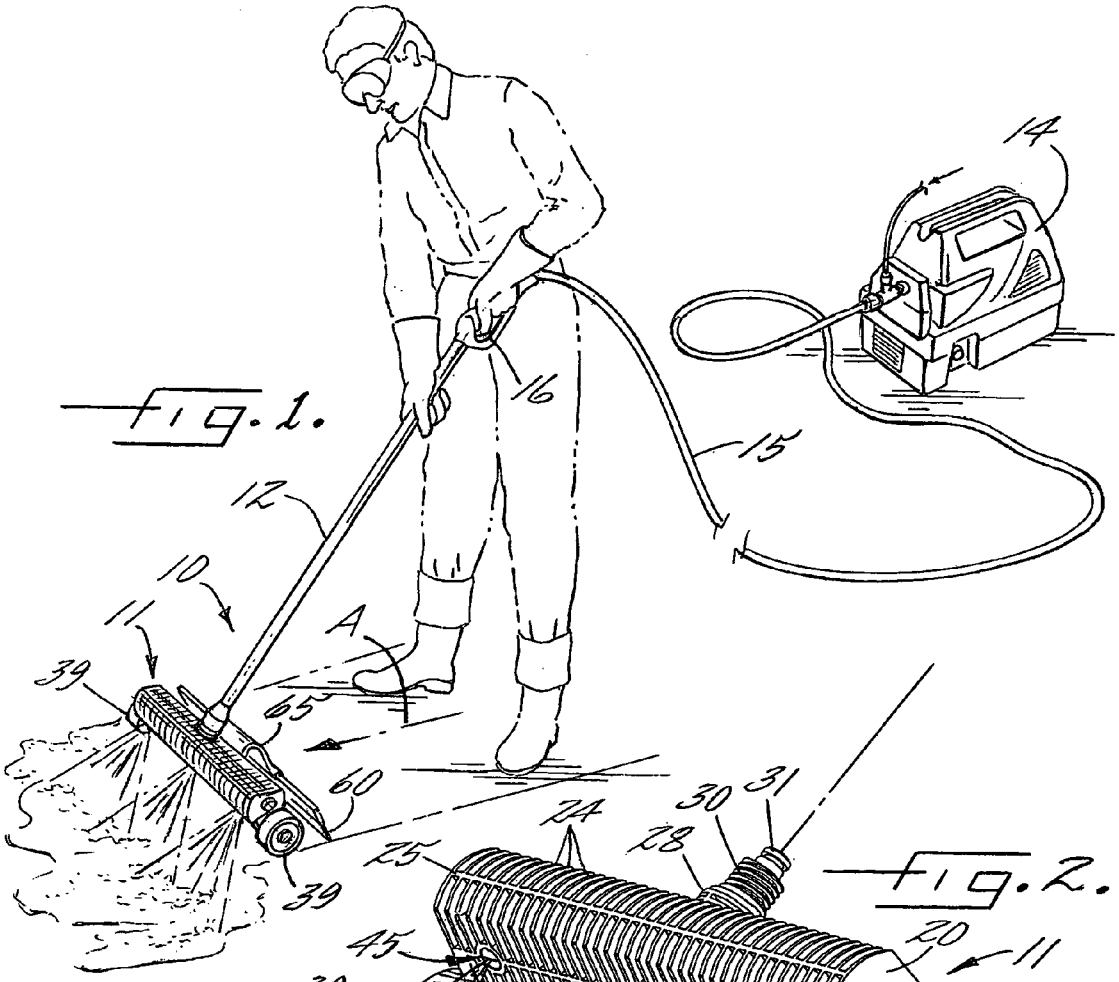
FIG. 1 is a perspective of a water floor broom in accordance with the invention being used by an operator to clean a floor surface.
Figure 2:
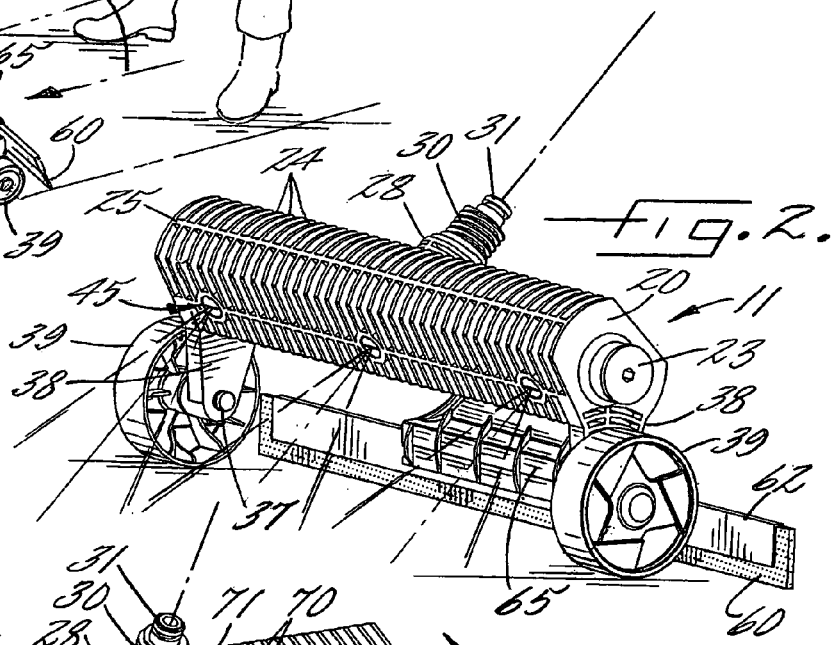
FIG. 2 is an enlarged front perspective of the spray head of the illustrated water floor broom.
Figure 3:
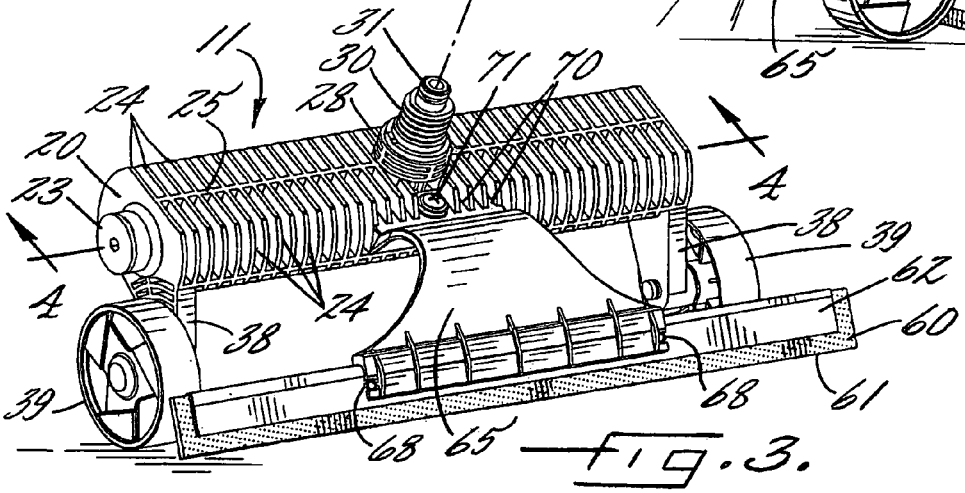
FIG. 3 is an enlarged rear perspective of the spray head of the illustrated water floor broom.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF PREFERRED EMBODIMENTS

Referring now more particularly to the drawings, there is shown an illustrative water floor broom 10 in accordance with the invention. The water broom 10 basically comprises a spray head 11 that is moveable along the floor, an elongated handle 12 fixed in upstanding relation to the spray head 11 for moving the spray head 11 along the floor, and a pressure washer pump 14 having a high pressure fluid transfer hose 15 with a control wand or gun 16 at an end thereof for supplying pressurized liquid to the spray head 11 through the handle 12. The pressure washer pump 14 may be of a conventional type, preferably a light weight electric powered pressured washer, capable of delivering a liquid flow stream up to at least 1.5 gpm at 1,100 psi. The gun 16 may be connected to the upper end of the handle 12 with an appropriate quick disconnect bayonet coupling effective for providing a releaseable fluid type connection therebetween. Through operation of the pressure washer pump 14, a cleaning fluid, typically water or optionally water mixed with a liquid soap or detergent, may be directed through the high pressure transfer line 15 and gun 16 to a liquid flow passage 18 in the handle 12 (FIG. 4) that communicates with the spray head 11. The gun 16 typically includes a trigger valve for allowing the operator to selectively control the supply of pressurized fluid to the spray head 11 during a cleaning operation.

In accordance with the invention, the spray head has a light weight, rigid construction which facilitates easy usage. To this end, the spray head 11 has an elongated body 20, preferably molded of rigid plastic material, comprising a central section 21 that defines an elongated internal manifold passageway 22 having a long axis oriented transverse to the line of movement of spray head (indicated by the arrow A in FIG. 1), a plurality of integrally formed laterally spaced radial fins 24 which extend in perpendicular relation to the elongated central section 21, and a plurality of longitudinal reinforcing ribs 25 interconnecting the radial ribs 24 extending in parallel relation to the long axis of central section 21. To facilitate plastic injection molding of the spray head body 20, the elongated manifold passageway 22 is formed with an open axial end, which in this case is closed by a separate plug 23. The combination of the central section 21, radial ribs 24, and longitudinal ribs 25 define a light weight, rigid body structure.

The spray head 11 in this case has an upstanding integrally formed hub 28 that defines the liquid flow passage 29 (FIG. 4) communicating centrally with the transverse manifold passage 22. The hub 28 has an externally threaded mounting section 30 for attachment by an internally threaded end of the broom handle 12 and an upstanding, smaller diameter nib 31 surrounded by an annular sealing ring 32 in interposed relation with a counterbore of the broom handle 12 that communicates with the broom handle passage 18. The hub 28 in this instance has a base portion also formed with a plurality of circular fins 34 disposed transversely to the radial fins 24 of the spray head.

For supporting the spray head 11 for rolling movement on the surface of a floor to be cleaned, the spray head body 20 has integrally formed, depending wheel-support legs 38 at opposite ends that each rotatably receive and support an inwardly directed shaft 37 of a respective wheel 39, also preferably made of rigid plastic material. (FIG. 4) A retaining clip 40 maintains the wheel shafts on the support legs 38.

In keeping with the invention, the spray head 11 includes a plurality of spray nozzles 45 each communicating with the manifold passageway 22 designed for providing high pressure liquid spray discharges for effective floor cleaning while minimizing cleaning fluid requirements. The spray head 11 in this case include three spray nozzles 45 which may be made of metal or rigid plastic material. The spray nozzles 45 each have an externally threaded upstream hub 46 adapted for threaded engagement with a respective spray nozzle receiving aperture in the underside of the spray head body 20. Each spray nozzle 45 has an internal flow passage defined by a relatively larger diameter upstream passage section 48, an intermediate smaller diameter central section 49, and a still smaller diameter nozzling section 50 which communicates with a cross slit 51 in the downstream end of the spray nozzle 45 oriented parallel to the long axis of the spray head body 11 for discharging relatively flat or fan spray patterns in partially overlapping in relation to each other such that a curtain of pressurized liquid having a lateral width corresponding at least the length of the spray head 11 is directed onto the floor surface to be cleaned as the spray head is moved along the floor. The spray nozzles 45 preferably are oriented for directing the discharging sprays forwardly of the spray head 11 for enabling the operator to observe the discharging spray patterns and to more effectively direct the pressurized curtain of cleaning liquid onto soiled areas of the floor.

The water floor broom 10 is not only relatively light weight and easy to manipulate, but is operable in discharging relatively high pressure liquid sprays for efficient floor cleaning even when operated by relatively inexpensive electric powered pressure washer pumps with lesser quantities of water or cleaning fluids than customarily used in much more expensive water floor brooms. It will be appreciated by one skilled in the art that this is advantageous both in enabling more efficient use of cleaning soaps or detergents, as well as minimizing the clean up of water and cleaning fluids directed onto the floor during cleaning.

In carrying out a another important aspect of the invention, the spray head 11 further has the rearwardly disposed squeegee blade 60 for scraping and clearing the water from the floor surface simultaneously as the water floor broom 10 is moved along the floor during a cleaning operation, thereby eliminating or substantially minimizing the messy clean up commonly required when using conventional water floor brooms. The squeegee blade 60, which may be made of a rubber or other suitable flexible material, preferably is formed with a sharp floor engaging edge 61 and extends transversely along a length of the spray head 11 corresponding at least to the lateral width spray discharge from the spray nozzles. The squeegee blade 60 in this case is supported along its upper periphery by a U-shaped blade holder 62, preferably made of rigid plastic material, which in turn is supported rearwardly of the spray head 11 by a blade mounting structure 65. The blade mounting structure 65 has a U-shaped gripper or clamping section 66 at its terminal end for removeably receiving the blade holder 62 with retaining pins 68 positionable within slots 69 in opposite ends of the gripper portion 66. The mounting structure 65 has a mounting flange at its forward end formed with a plurality of laterally spaced fingers 70 positionable between respective radial fins 24 of the spray head body 20 and which is secured to the spray head body by a central mounting screw 71.

In further carrying out the invention, the squeegee blade mounting structure 65 has a downwardly directed radiused or U-shaped connecting structure, preferably made of a flexible plastic material, which extends rearwardly and downwardly of the spray head 11 for enabling easy adjustment in the angle and pressure of the squeegee blade 60 against the floor surface by an operator using the water broom 10. As depicted in FIGS. 5A and 5B, as an incident to raising and lowering movement of the broom handle 12, and hence pivotable movement of the spray head 11 about the axis of the wheels 39, the flexible mounting structure 65 will deflect to change both the angle of the squeegee blade 60 against the floor surface and its pressure for most effective clearing of liquid from the floor surface as the water broom is moved in a forward cleaning direction. It will be appreciated by one skilled in the art that by virtue of the rearwardly disposed squeegee blade attachment, the operator can effectively clean the floor surface while simultaneously scraping and clearing the water from the cleaned surface so as to eliminate the necessity for subsequent mopping of the cleaned surface area. Instead, simultaneous with cleaning, the dispersed water may be easily moved toward a drain, or to a central area for easier clean up.

From the foregoing, it can be seen that the water floor broom of the present invention is adapted for easier and more efficient usage in cleaning floors. The water floor broom substantially minimizes or eliminates the necessity for later mopping or clean up of water or other cleaning liquids directed onto the floor during cleaning. The water floor broom also is relatively light in weight and economical in construction and can be operated with lesser quantities of water or other cleaning fluids.

What is claimed is:

1. A floor spraying apparatus for cleaning a floor surface comprising a spray head having an elongated body defining an elongated manifold liquid flow passage, a handle fixed to said spray head body for guiding movement of said spray head along a floor surface to be cleaned, said handle having an elongated internal liquid flow passage extending through said handle in fluid communication with said spray head manifold passageway, a power washer pump coupled to said handle for directing a pressurized liquid flow stream through said handle passage and spray head manifold passageway, a plurality of spray nozzles fixed to said spray head body in fluid communication with said elongated manifold passageway for receiving pressurized liquid and directing pressurized spray discharge outwardly and forwardly of said spray head along a lateral width in visible relation to an operator of said spray apparatus for cleaning the floor surface; and a squeegee blade extending laterally a distance corresponding at least as long as the lateral width of the discharging liquid spray from said nozzles and secured in rearwardly spaced relation to said spray head for scraping and cleaning water from the surface of the floor simultaneously as liquid is directed onto the floor surface by said spray nozzles.

2. The floor spraying apparatus of claim 1 in which said squeegee is made of a flexible material.

3. The floor spraying apparatus of claim 2 in which said squeegee blade has a generally pointed bottom edge for riding on and clearing liquid from the floor surface.

4. The floor spraying apparatus of claim 1 in which the squeegee blade is operable for bearing against the floor surface at an acute angle thereto, and the bearing pressure and angle of the squeegee blade relative to the floor surface is changeable by manually raising and lowering said handle.

5. The floor spraying apparatus of claim 1 in which said spray head body has a molded plastic construction, and said power washer pump is an electric powered power washer.

6. The floor spraying apparatus of claim 1 in which said spray head body having a pair of wheels at opposite elongated ends thereof for supporting the spray head for rolling movement along the floor surface while permitting selected pivotal movement of the spray head about an axis of said wheels.

7. A floor spraying apparatus for cleaning a floor surface comprising, a spray head having an elongated handle fixed in an upstanding relation thereto, said spray head including a rigid plastic molded body having an elongated section defining an elongated manifold liquid passageway, said handle having an elongated passage extending through said handle in fluid communication with said elongated manifold passageway, a plurality of integrally formed radial fins extending outwardly of said elongated body section in perpendicular relation to a long axis of said elongated body section, a plurality of integral longitudinal ribs extending in parallel relation to the long axis of said elongated body section interconnecting said radial fins, a pair of wheels rotatably supported at opposite elongated ends of said spray head body for supporting the spray head for rolling movement along a floor surface to be cleaned, an electric powered power pressure washer pump having a control wand releasably connectable to said handle for directing pressurized liquid through said handle passage to said elongated manifold passageway, a plurality of spray nozzles fixed in said body in fluid communication with said manifold passageway for directing pressurized spray discharges onto the floor surface as the spray head is moved along a path movement on said floor surface, and said spray nozzles being designed to discharge a fan spray patterns in partially overlapping relation to each other for cleaning a predetermined lateral width of the floor surface upon movement of the spray head along the floor surface.

8. The floor spraying apparatus of claim 7 in which said spray head body has an integral formed threaded hub for threadedly engaging said handle, said threaded hub being formed with a liquid passageway communicating between said handle passage and said elongated manifold passageway.

9. The floor spraying apparatus of claim 8 in which said hub is formed with a plurality of spaced fins disposed in parallel relation to the longitudinal axis of said elongated manifold passageway.

10. The floor spraying apparatus of claim 7 including a squeegee blade secured to said spray head rearwardly thereof for scraping and cleaning water from the surface of the floor simultaneously as liquid is directed onto the floor surface by said spray nozzles.

11. The floor spraying apparatus of claim 10 in which the squeegee blade is operable for bearing against the floor surface at an angle thereto, and the bearing pressure and angle of the squeegee blade relative to the floor surface is changeable by manually raising and lowering said handle.

12. The floor spraying apparatus of claim 11 including a squeegee blade mounting structure having a forward flange for releaseable securement to said spray head body and a rearward clamping section for receiving and supporting an upper peripheral edge of said squeegee blade.

13. The floor spraying apparatus of claim 7 in which said spray nozzles are mounted for directing pressurized spray discharges outwardly and forwardly of said spray head in visible relation to an operator of said spraying apparatus.

14. A floor spraying apparatus for cleaning a floor surface comprising a spray head having an elongated body defining an elongated manifold liquid flow passage, a handle fixed to said spray head body defining a liquid flow passage communicating with said spray head manifold passageway, a power washer pump having a control wand releasably coupled to said handle for directing a pressurized liquid flow stream through said handle passage and spray head manifold passageway, a plurality of spray nozzles fixed to said spray head body in fluid communication with said elongated manifold passageway for receiving pressurized liquid and directing a discharging pressurized spray onto a floor surface for cleaning the floor surface;

a squeegee blade secured to said spray head rearwardly thereof for scraping and cleaning water from the surface of the floor simultaneously as liquid is directed onto the floor surface by said spray nozzles, and said squeegee blade being secured to said spray head at an angle to the floor surface to be cleaned by a flexible mounting member that bends in relation to the pressure of said squeegee blade against said floor surface for changing the angle of the squeegee blade in relation to the floor surface.

15. A floor spraying apparatus for cleaning a floor surface comprising a spray head having an elongated body defining an elongated manifold liquid flow passage, a handle fixed to said spray head body defining a liquid flow passage communicating with said spray head manifold passageway, a power washer pump having a control wand releasably coupled to said handle for directing a pressurized liquid flow stream through said handle passage and spray head manifold passageway, a plurality of spray nozzles fixed to said spray head body in fluid communication with said elongated manifold passageway for receiving pressurized liquid and directing a discharging pressurized spray onto a floor surface for cleaning the floor surface;

a squeegee blade secured to said spray head rearwardly thereof for scraping and cleaning water from the surface of the floor simultaneously as liquid is directed onto the floor surface by said spray nozzles, and a squeegee blade mounting structure having a forward flange for releasable securement to said spray head body and a rearward clamping section for receiving and supporting an upper peripheral edge of said squeegee blade, said mounting structure supporting said squeegee blade with an edge in bearing engagement against the floor surface with a bearing pressure and at an angle of the squeegee blade relative to the floor surface changeable by manually raising and lowering said handle.

16. A floor spraying apparatus for cleaning a floor surface comprising a spray head having an elongated body defining an elongated manifold liquid flow passage, a handle fixed to said spray head body defining a liquid flow passage communicating with said spray head manifold passageway, a power washer pump releasably coupled to said handle for directing a pressurized liquid flow stream through said handle passage and spray head manifold passageway, a plurality of spray nozzles fixed to said spray head body in fluid communication with said elongated manifold passageway for receiving pressurized liquid and directing a discharging pressurized spray onto a floor surface for cleaning the floor surface;

a squeegee blade secured to said spray head rearwardly thereof for scraping and cleaning water from the surface of the floor simultaneously as liquid is directed onto the floor surface by said spray nozzles, a pair of wheels at opposite lateral sides of said spray head providing sole support of said spray head for rolling movement over a floor surface under the guidance of said handle, and said spray head being pivotable about an axis of said wheels as an incident to raising and lowering of said handle for changing the bearing pressure and angle of engagement of the squeegee blade with the floor surface.

17. The floor spraying apparatus of claim 16 in which said squeegee is supported on said spray head by a flexible mounting structure.

* * * * *